US010370214B2

(12) United States Patent
Moscato et al.

(10) Patent No.: US 10,370,214 B2
(45) Date of Patent: Aug. 6, 2019

(54) POSITION CONTROL SYSTEM AND METHOD

(71) Applicant: R.R. DONNELLEY & SONS COMPANY, Chicago, IL (US)

(72) Inventors: Anthony V. Moscato, North Tonawanda, NY (US); Theodore F. Cyman, Jr., Grand Island, NY (US); Paul Slagle, Grand Island, NY (US)

(73) Assignee: Cryovac, LLC, Charlotte, NC (US)

( * ) Notice: Subject to any disclaimer, the term of this patent is extended or adjusted under 35 U.S.C. 154(b) by 79 days.

(21) Appl. No.: 15/609,349

(22) Filed: May 31, 2017

(65) Prior Publication Data

US 2018/0346274 A1 Dec. 6, 2018

(51) Int. Cl.
*B65H 23/038* (2006.01)
*B41J 15/04* (2006.01)

(52) U.S. Cl.
CPC ..... *B65H 23/038* (2013.01); *B41J 15/04* (2013.01); *B65H 2301/443243* (2013.01)

(58) Field of Classification Search
CPC ..... B65H 23/0204; B65H 23/038; B65H 2404/15212; B65H 2404/1523; B65H 2404/1526; B65H 2404/14212; B65H 2404/1424; B65H 2404/161; B65H 2404/172; B65H 2301/443243
See application file for complete search history.

(56) References Cited

U.S. PATENT DOCUMENTS 3,405,855 A * 10/1968 Daly ..... B65H 18/20 226/1
3,595,459 A * 7/1971 Colombo ..... B65H 23/02 226/21
3,599,229 A 8/1971 Merrell
3,717,722 A 2/1973 Messner
3,803,628 A 4/1974 Van Brimer et al.
3,911,818 A 10/1975 MacIlvaine
3,925,790 A 12/1975 Fischbeck
4,146,900 A 3/1979 Arnold
(Continued)

FOREIGN PATENT DOCUMENTS

EP 0 317 762 5/1989
EP 0 319 223 6/1989
(Continued)

OTHER PUBLICATIONS

AccuGuide Steering Roll Assemblies, dated Nov. 2, 2016, http://www.accuweb.com/steering.html (4 pages).

*Primary Examiner* — Michael C McCullough
(74) *Attorney, Agent, or Firm* — McCracken & Gillen LLC

(57) ABSTRACT

A position control system includes a roller rotatable about a longitudinal axis thereof and a pivotable member having a first member end rotatable about a first pivot axis and a second member end coupled to the roller. The second member end is rotatable about a second pivot axis spaced from the first pivot axis and the first and second pivot axes are movable relative to one another. A motor is adapted to move the roller along the longitudinal axis wherein movement of the roller along the longitudinal axis causes the pivotable member to pivot the roller relative to the longitudinal axis. A control system is responsive to a sensed parameter for controlling the motor. A position control method is also disclosed.

17 Claims, 11 Drawing Sheets

(56) References Cited

U.S. PATENT DOCUMENTS

| | | | | |
|---|---|---|---|---|
| 4,219,822 | A | 8/1980 | Paranjpe | |
| 4,238,804 | A | 12/1980 | Warren | |
| 4,291,825 | A * | 9/1981 | Glanz | B65H 23/0216 101/228 |
| 4,320,406 | A | 3/1982 | Heinzl | |
| 4,401,024 | A | 8/1983 | Frentress | |
| 4,463,359 | A | 7/1984 | Ayata et al. | |
| 4,477,103 | A | 10/1984 | Bertolazzi | |
| 4,728,968 | A | 3/1988 | Hillmann et al. | |
| 4,736,213 | A | 4/1988 | Piatt et al. | |
| 4,789,147 | A | 12/1988 | Berger et al. | |
| 4,792,860 | A | 12/1988 | Kuehrle | |
| 4,804,979 | A | 2/1989 | Kamas et al. | |
| 4,835,713 | A | 5/1989 | Pastor | |
| 4,839,674 | A | 6/1989 | Hanagata et al. | |
| 4,847,660 | A | 7/1989 | Wheatley, Jr. et al. | |
| 4,878,063 | A | 10/1989 | Katerberg | |
| 4,994,975 | A | 2/1991 | Minschart | |
| 5,031,530 | A | 7/1991 | Burger | |
| 5,069,124 | A | 12/1991 | Schneider | |
| 5,079,571 | A | 1/1992 | Eriksen | |
| 5,087,805 | A | 2/1992 | Silverschotz et al. | |
| 5,102,110 | A | 4/1992 | Reynolds | |
| 5,129,568 | A | 7/1992 | Fokos et al. | |
| 5,137,304 | A | 8/1992 | Silverschotz et al. | |
| 5,160,946 | A | 11/1992 | Hwang | |
| 5,224,640 | A | 7/1993 | Fokos et al. | |
| 5,266,976 | A | 11/1993 | Ohigashi et al. | |
| 5,287,162 | A | 2/1994 | de Jong et al. | |
| 5,289,208 | A | 2/1994 | Haselby | |
| 5,298,761 | A | 3/1994 | Aoki et al. | |
| 5,313,886 | A | 5/1994 | Mueller | |
| 5,365,847 | A | 11/1994 | Pers | |
| 5,384,592 | A | 1/1995 | Wong | |
| 5,408,746 | A | 4/1995 | Thoman et al. | |
| 5,434,956 | A | 7/1995 | Son et al. | |
| 5,568,168 | A | 10/1996 | Watanabe et al. | |
| 5,617,128 | A | 4/1997 | Thoman et al. | |
| 5,648,801 | A | 7/1997 | Beardsley et al. | |
| 5,688,059 | A | 11/1997 | Clarke et al. | |
| 5,689,289 | A | 11/1997 | Watanabe et al. | |
| 5,704,282 | A | 1/1998 | Khalid | |
| 5,715,498 | A | 2/1998 | Takeuchi et al. | |
| 5,765,083 | A | 6/1998 | Shinohara | |
| 5,765,481 | A | 6/1998 | Tortora et al. | |
| 5,784,077 | A | 7/1998 | Silverbrook | |
| 5,793,397 | A | 8/1998 | Barker et al. | |
| 5,796,411 | A | 8/1998 | Cyman et al. | |
| 5,796,414 | A | 8/1998 | Sievert et al. | |
| 5,797,305 | A | 8/1998 | Harrod et al. | |
| 5,806,430 | A | 9/1998 | Rodi | |
| 5,868,069 | A | 2/1999 | Khalid et al. | |
| 5,889,534 | A | 3/1999 | Johnson et al. | |
| 5,937,756 | A | 8/1999 | Kishine et al. | |
| 5,949,438 | A | 9/1999 | Cyman et al. | |
| 5,995,717 | A | 11/1999 | Tanaka | |
| 6,003,988 | A | 12/1999 | McCann et al. | |
| 6,065,400 | A | 5/2000 | Van Weverberg | |
| 6,068,362 | A | 5/2000 | Dunand et al. | |
| 6,072,587 | A | 6/2000 | Hicks | |
| 6,109,722 | A | 8/2000 | Underwood et al. | |
| 6,120,142 | A | 9/2000 | Eltgen et al. | |
| 6,126,267 | A | 10/2000 | Ito et al. | |
| 6,146,035 | A | 11/2000 | Ishigouoka et al. | |
| 6,236,463 | B1 | 2/2001 | Cyman et al. | |
| 6,213,580 | B1 | 4/2001 | Segerstrom et al. | |
| 6,224,192 | B1 | 5/2001 | Robinson et al. | |
| 6,317,147 | B1 | 11/2001 | Tanaka | |
| 6,325,480 | B1 | 12/2001 | Moghadam et al. | |
| 6,334,666 | B1 | 1/2002 | Inui et al. | |
| 6,375,296 | B1 | 4/2002 | McGarry et al. | |
| 6,390,588 | B1 | 5/2002 | Ikeda | |
| 6,409,301 | B1 | 6/2002 | Takata et al. | |
| 6,411,324 | B1 | 6/2002 | Christiansen et al. | |
| 6,422,678 | B1 | 7/2002 | Serra et al. | |
| 6,446,100 | B1 | 9/2002 | Warmus et al. | |
| 6,450,382 | B1 * | 9/2002 | Ohno | B65H 23/0204 226/21 |
| 6,450,607 | B1 | 9/2002 | Bolash et al. | |
| 6,450,614 | B1 | 9/2002 | Scheffelin et al. | |
| 6,460,441 | B1 | 10/2002 | Harrod | |
| 6,467,768 | B1 | 10/2002 | Vary et al. | |
| 6,467,874 | B1 | 10/2002 | Williams et al. | |
| 6,474,886 | B1 | 11/2002 | Sugiyama et al. | |
| 6,499,822 | B1 | 12/2002 | Abe et al. | |
| 6,547,370 | B2 | 4/2003 | Mantell et al. | |
| 6,599,040 | B2 | 7/2003 | Nakazawa et al. | |
| 6,622,621 | B2 | 9/2003 | Bucher et al. | |
| 6,637,860 | B1 | 10/2003 | Madeley | |
| 6,644,773 | B2 | 11/2003 | Bildstein et al. | |
| 6,663,206 | B2 | 12/2003 | Taylor | |
| 6,682,163 | B2 | 1/2004 | Metzler et al. | |
| 6,688,721 | B1 | 2/2004 | Serra | |
| 6,712,444 | B2 | 3/2004 | Abe et al. | |
| 6,763,220 | B2 | 7/2004 | Nakazawa | |
| 6,789,870 | B2 | 9/2004 | Barnes et al. | |
| 6,891,630 | B1 | 5/2005 | Miyasaka et al. | |
| 6,909,516 | B1 | 6/2005 | Hoover | |
| 7,013,803 | B2 | 3/2006 | Hansen et al. | |
| 7,014,289 | B1 | 3/2006 | Matsuda | |
| 7,021,732 | B2 | 4/2006 | Folkins | |
| 7,021,738 | B2 | 4/2006 | Juan et al. | |
| 7,061,630 | B2 | 6/2006 | Murray | |
| 7,108,369 | B2 | 9/2006 | Newsome et al. | |
| 7,168,784 | B2 | 1/2007 | Donovan et al. | |
| 7,209,600 | B2 | 4/2007 | Goldberg | |
| 7,216,952 | B2 | 5/2007 | Claramunt et al. | |
| 7,242,494 | B2 | 7/2007 | Hanazato | |
| 7,251,437 | B2 | 7/2007 | Tamoto et al. | |
| 7,265,769 | B2 | 9/2007 | Amarakoon | |
| 7,309,118 | B2 | 12/2007 | Mizes et al. | |
| 7,390,133 | B2 | 6/2008 | Hatayama | |
| 7,543,911 | B2 | 6/2009 | Mizes et al. | |
| 7,552,986 | B2 | 6/2009 | Mizes et al. | |
| 7,789,310 | B2 | 9/2010 | Butikofer | |
| 7,967,407 | B2 | 6/2011 | Moscato et al. | |
| 8,339,660 | B2 | 12/2012 | Kageyama et al. | |
| 8,461,562 | B2 * | 6/2013 | Hashimoto | B65H 23/048 250/559.05 |
| 9,890,006 | B2 * | 2/2018 | Hashikawa | B21C 47/006 |
| 2002/0167554 | A1 | 11/2002 | Parry | |
| 2005/0073539 | A1 | 4/2005 | McGarry et al. | |
| 2006/0139392 | A1 | 6/2006 | Fernandez et al. | |
| 2011/0135405 | A1 * | 6/2011 | Miyaji | B65H 23/24 406/70 |

FOREIGN PATENT DOCUMENTS

| | | |
|---|---|---|
| EP | 0 835 761 | 4/1998 |
| EP | 1 522 411 | 4/2005 |
| FR | 2 605 268 | 4/1988 |
| JP | 401142671 | 6/1989 |
| JP | 405016341 | 1/1993 |
| JP | 08143182 | 6/1996 |
| JP | 408216467 | 8/1996 |
| JP | 408290560 | 11/1996 |
| JP | 2004112045 | 4/2004 |
| WO | WO 2007/092490 | 8/2007 |

* cited by examiner

POSITION CONTROL SYSTEM AND METHOD

FIELD OF DISCLOSURE

The present subject matter relates to a system and method for controlling position.

BACKGROUND

In some production processes, a web is transported past one or more devices that undertake manufacturing step(s). In other processes, the web itself is modified in some manner, such as by applying inks and/or coatings thereto.

In any such production processes, it is important that the web be precisely registered with the equipment undertaking the manufacturing step(s) so that the step(s) are undertaken correctly. Accuracy in the process direction is accomplished by accurate installation of production line components, and accurate control of web speed. Lateral positioning transverse to the process direction is accomplished by, among other things, accurately controlling the lateral web position. Most web steering or guiding systems that control lateral web position are intended for positioning a web as it enters a process from a source roll.

A known steering roll assembly sold by AccuWeb, Inc. of Madison, Wis., utilizes steering rolls mounted within a movable frame. A linear bearing system and linear actuator allow motion of the movable frame accomplishing the desired web steering function. The linear actuator is controlled by a control system that responds to measurements provided by a web edge sensor. Pivoting of the movable frame relative to an adjustable theoretical pivot point maintains a desired lateral web position. It has been found, however, that this steering roll assembly is not suitable for use in certain environments where space is limited due to constraints imposed by the process that is being undertaken. A more compact steering mechanism may also be required when adding this capability to existing equipment.

Most web steering or guiding systems are intended for positioning a web as it enters a process from a source roll. The guiding system corrects for a roll that is offset to one side or the other (a static error) or a roll that has lateral runout (uneven edge).

SUMMARY

According to an exemplary embodiment, a position control system includes a roller rotatable about a longitudinal axis thereof and a pivotable member having a first member end rotatable about a first pivot axis and a second member end coupled to the roller. The second member end is rotatable about a second pivot axis spaced from the first pivot axis and the first and second pivot axes are movable relative to one another. A motor is adapted to move the roller along the longitudinal axis wherein movement of the roller along the longitudinal axis causes the pivotable member to tilt the roller relative to the longitudinal axis. A control system is responsive to a sensed parameter for controlling the motor.

According to another exemplary embodiment, a web position control system for controlling a position of a web to be guided by a roller rotatable about a longitudinal axis thereof includes a mounting structure that mounts the roller for rotational movement about the longitudinal axis, linear movement parallel to the longitudinal axis, and tilting movement relative to the longitudinal axis. A pivotable linkage has a first linkage end rotatable about a first pivot axis and a second linkage end coupled to the roller wherein the second linkage end is rotatable about a second pivot axis spaced from the first pivot axis and wherein the first pivot axis is fixed and the second pivot axis is movable relative to the first pivot axis. A motor is adapted to move the roller along the longitudinal axis wherein movement of the roller along the longitudinal axis causes the pivotable member to tilt the roller relative to the longitudinal axis. A control system includes a web position sensor for controlling the motor.

According to yet another exemplary embodiment, a method of controlling lateral position of a web traveling over a roller wherein the roller is mounted for rotation about a longitudinal axis by first and second opposed shaft portions includes the step of providing a linkage having a first end rotatable about a fixed axis and a second end rotatable about a movable axis spaced from the fixed axis wherein the second end of the linkage is coupled to the roller. The method further includes the step of providing a mounting structure and the step of providing a motor wherein the mounting structure mounts the roller for rotational movement about the longitudinal axis, linear movement parallel to the longitudinal axis, and tilting movement relative to the longitudinal axis. The motor is coupled to one of the first and second shaft portions and adapted to move the roller along the longitudinal axis wherein movement of the roller along the longitudinal axis causes the linkage to tilt the roller relative to the longitudinal axis. The method still further comprises the steps of sensing the lateral position of the web; and controlling the motor in response sensed lateral position of the web in turn to control lateral web position.

Other aspects and advantages will become apparent upon consideration of the following detailed description and the attached drawings wherein like numerals designate like structures throughout the specification.

DETAILED DESCRIPTION

Figure 1:
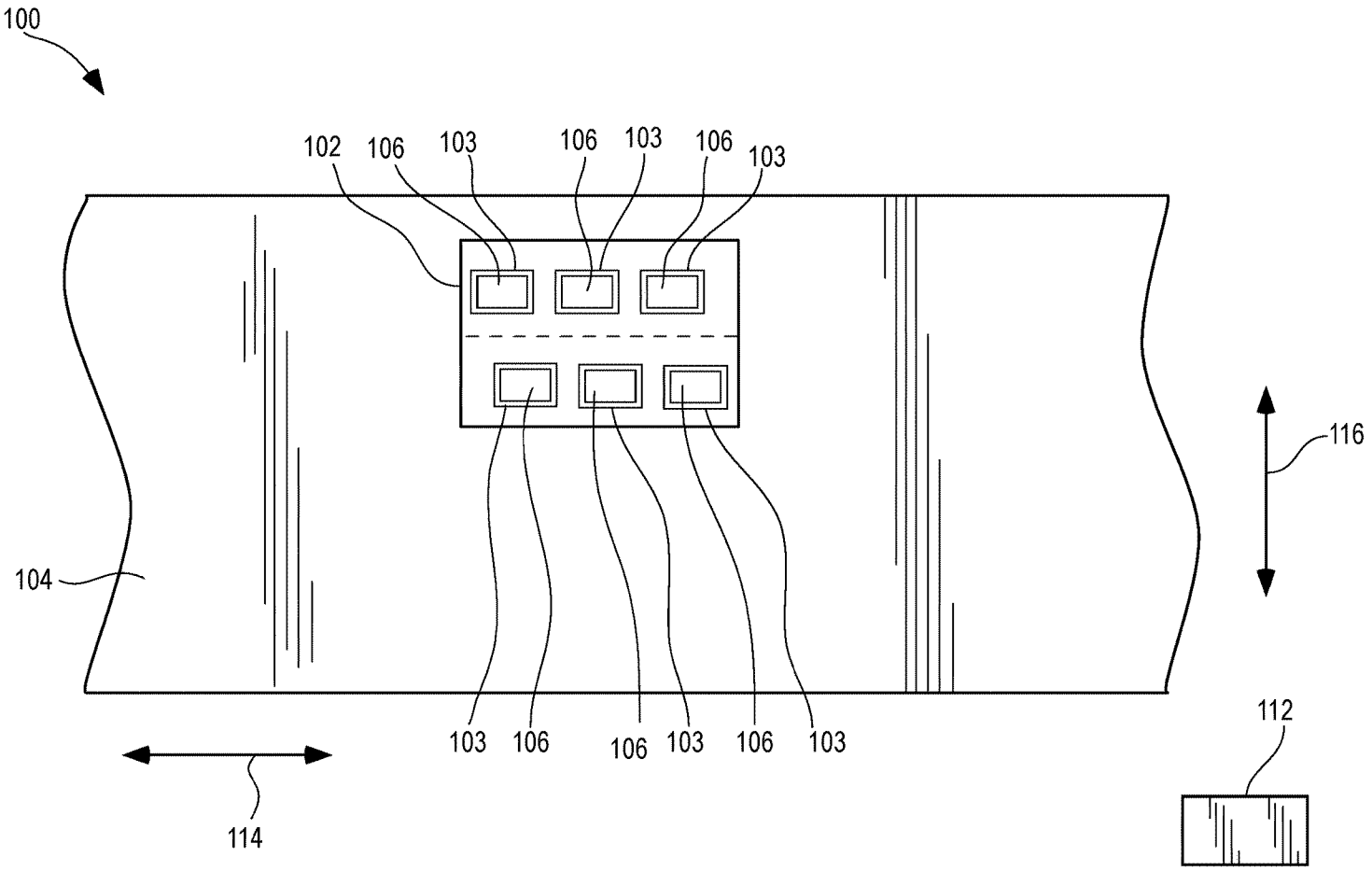
FIG. 1 is a plan view of a printing system.

Referring to FIG. 1, a manufacturing system in the form of a printing system 100 includes a print unit 102 arranged to eject ink toward a medium 104. The print unit 102 comprises at least one mount 103 and one or more printheads 106 may be disposed in each mount 103.

In some exemplary embodiments, each printhead 106 of the print unit 102 may print a particular color of ink. As may be apparent to one of skill in the art, the print unit 102 may include, for example, four printheads 106 that print cyan, magenta, yellow, and black ink to form four-color images on the medium 104. The print unit 102 may also include one or more other printheads 106 that print a custom color ink, a white ink, a metallic ink, and/or the like. Each printhead 106 includes a nozzle plate (not shown) having a plurality of nozzles (orifices) and during operation ink or another liquid may be ejected through such nozzles and deposited on the medium 104. The medium 104 may be any substrate on which ink or another material ejected by the printhead 106 may be deposited.

In an exemplary embodiment, the printing system 100 includes a controller 112 to coordinate relative movement between the print unit 102 and the medium 104, operation of the printheads 106 to print an image on the medium 104, and other functions, such as maintenance of the printheads 106. In some embodiments, during printing, the medium 104 may be transported in a direction parallel to a first axis 114 while the print unit 102 is transported in a direction parallel to a second axis 116 perpendicular to the first axis 114. In other embodiments, the print unit 102 may be transported in directions parallel to both the first axis 114 and the second axis 116, while the medium 104 is transported parallel to the first axis 114. Other variations of relative movement are possible.

Figure 1A:
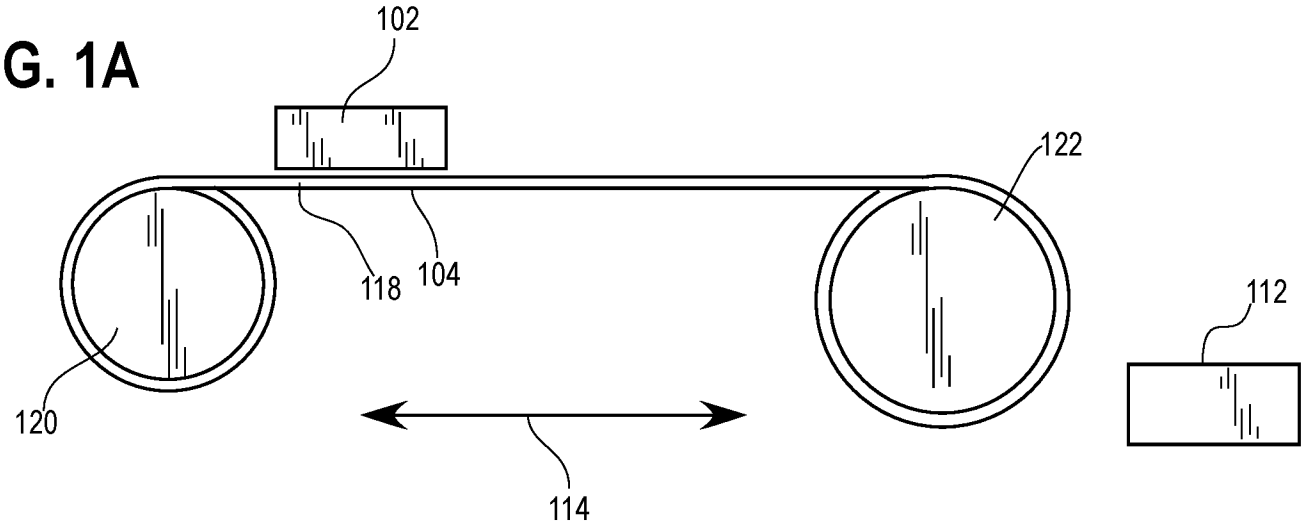
FIG. 1A is a diagrammatic side elevational view of an exemplary simplified embodiment of the printing system of FIG. 1.

Referring to FIG. 1A, in one exemplary embodiment, the medium 104 is a web 118 of material to be printed on and supplied from a supply roller 120. In such embodiments, the controller 112 operates the supply roller 120 and/or a take up roller 122 to transport the medium 104 past the print unit 102. In another exemplary embodiment, medium 104 may be processed by a finishing station that cuts and/or folds the printed web 118 to produce deliverable products. In either embodiment, the controller 112 may control one or more motors (not shown) coupled to the supply roller 120 and/or the take up roller 122, and/or may control the finishing station to synchronize movement of the web 118 with operation of the print unit 102.

Figure 2:
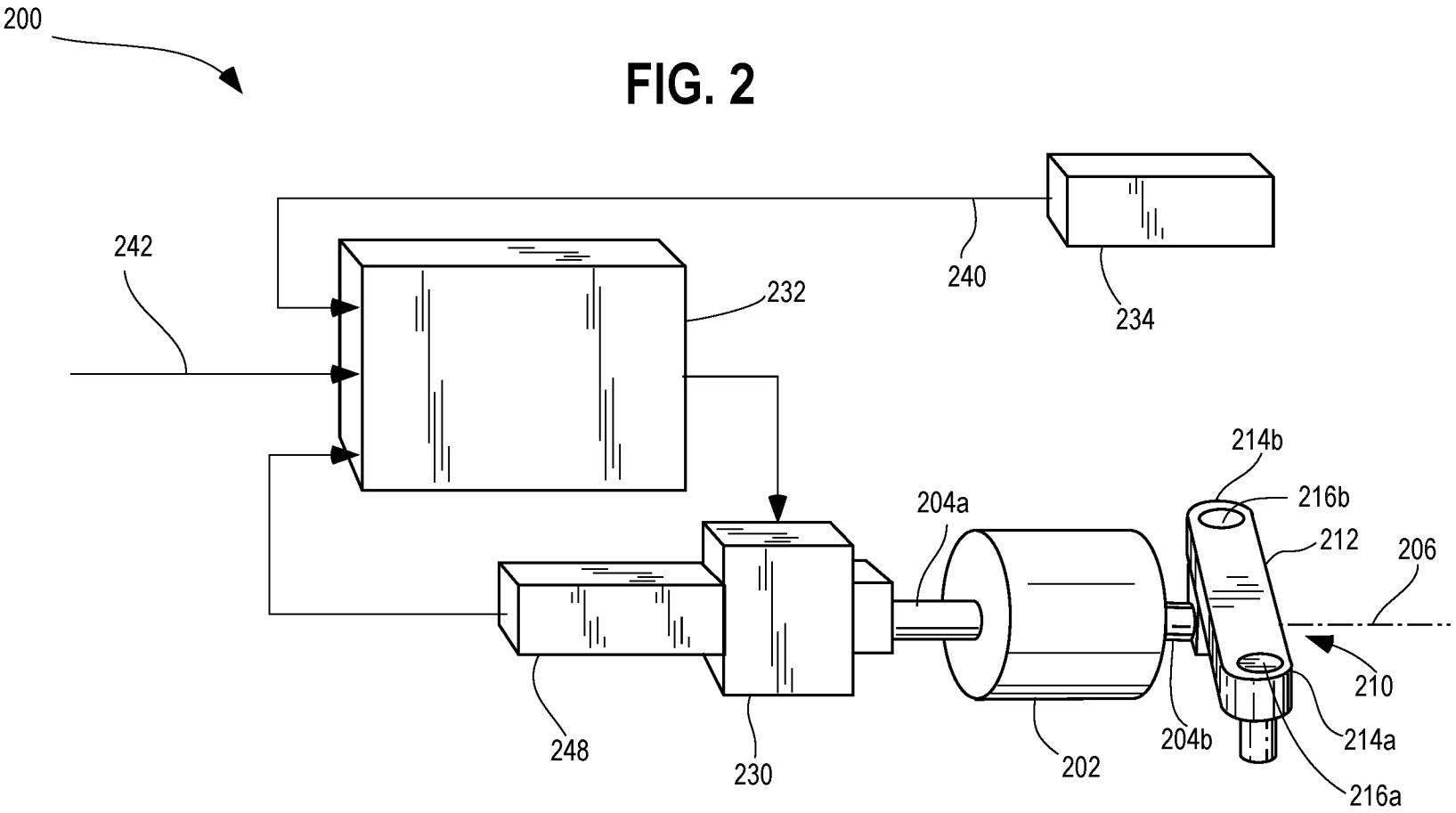
FIG. 2 is a simplified combined block and diagrammatic view of a position control system.

In the illustrated exemplary embodiments, some provision must be made to register the medium 104 with respect to the components of the printing system 100. Diagrammatically illustrated in FIG. 2 is a position control system 200 that may be disposed between the supply roller 120 and take up roller 122 of FIG. 1A. The position control system 200 includes a roller 202 that may comprise an idler roller or a driven roller. The roller 202 may be disposed at the same or a different elevation and/or lateral position with respect to other rollers 120, 122, optionally with other rollers and/or other guiding or other devices, as necessary or desirable. Preferably, the position control system 200 maintains the lateral position of the web 118 at a commanded target position, in turn to control the registration of the medium 104 with the components of the printing system 100.

In an exemplary embodiment, the roller 202 may include integral outwardly extending roller shaft portions 204*a*, 204*b* or the outwardly extending shaft portions 204*a*, 204*b* may be integral with or unitarily formed with a central shaft section (seen in later FIGS.) and the roller 202 may be journaled on the central shaft section and/or the outwardly extending roller shaft portions 204*a*, 204*b*. In either event, the roller shaft portions 204*a*, 204*b* are mounted by bearings and/or other devices as described in greater detail hereinafter to maintain the roller in position along an x-direction (also referred to herein as the process direction) while permitting movement generally along a y-direction perpendicular to the x-direction (the y-direction is also referred to herein as the lateral direction). The roller 202 is rotatable about a longitudinal axis 206 of the roller 202 and the lateral movement along the y-direction generally occurs along the longitudinal axis 206. As noted in greater detail hereinafter, the roller 202 is also mounted for tilting movement of the longitudinal axis 206. Tilting of the longitudinal axis 206 of the roller 202 causes the lateral portions of the web 118 to traverse differential travel paths, in turn leading to the ability to control the lateral position of the web 118.

The control system 200 of FIG. 2 further includes a pivotable member 210 that may be a single integral element or two or more elements that are unitarily formed. In the preferred embodiment, the member 210 comprises a linkage 212 having first and second ends 214*a*, 214*b* mounted to rotary bearing sets 216*a*, 216*b*, respectively. The rotary bearing set 216*a* is mounted to a fixed element (not shown in FIG. 2) so that the end 214*a* is only able to rotate about the bearing set 216*a*. The second end 214*b*, on the other hand, is not attached to a fixed element, and is therefore free to translate along an arcuate path about the bearing set 216*a*, and is also free to rotate about the bearing set 216*b*. The second end 214*b* is coupled either directly or by one or more structural elements to the roller 202. In the illustrated embodiment, the second end 214*b* is coupled to the shaft portion 204*b* either directly or via one or more structural elements. If desired, the second end 214*b* of the linkage 212 may be coupled either directly or by one or more structural elements to the shaft portion 204*a* or another structure in contact with the roller 202.

Figure 2A:
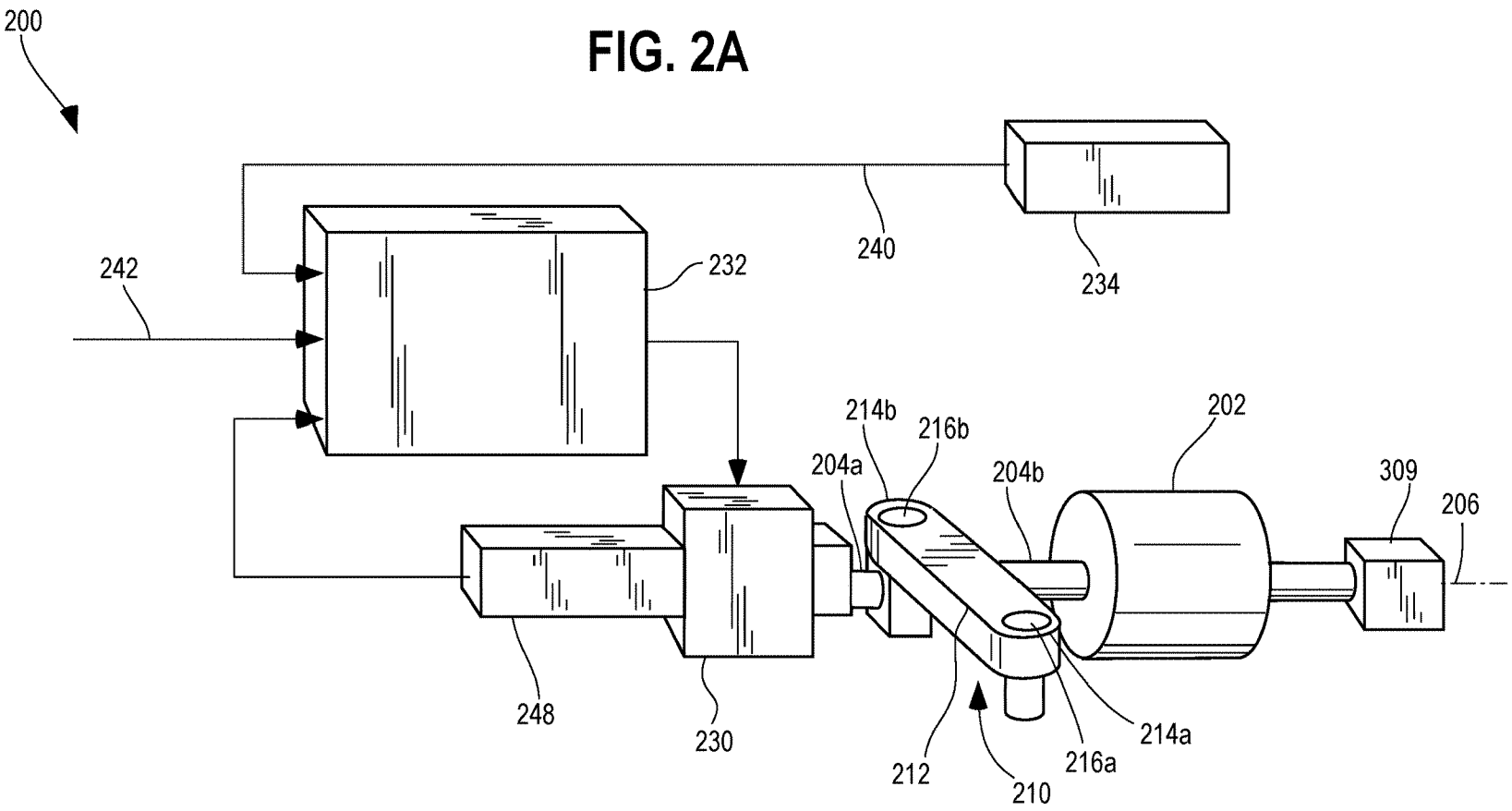
FIG. 2A is a view similar to FIG. 2 illustrating an alternative exemplary embodiment of a position control system.
Figure 3:
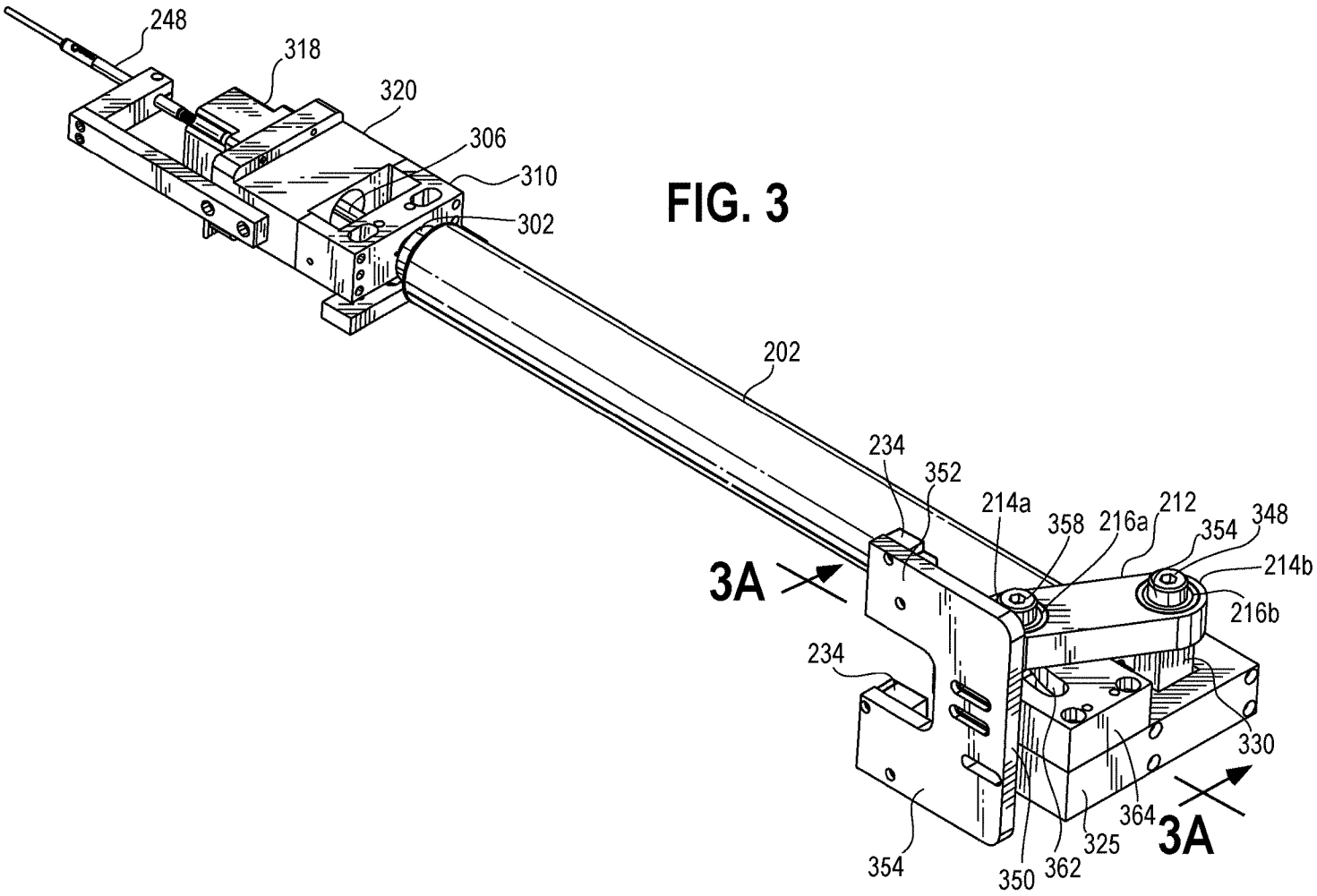
FIG. 3 is an isometric view of mechanical components of a specific exemplary embodiment of the position control system of FIG. 2.
Figure 3A:
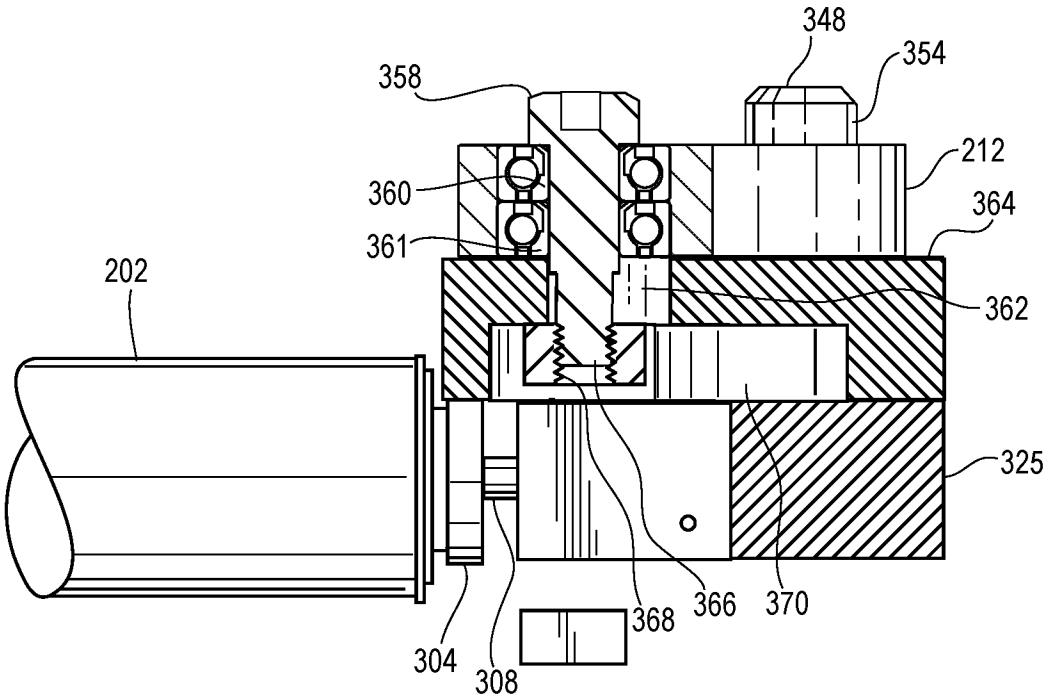
FIG. 3A is a sectional view taken generally along the lines 3-3 of FIG. 3.
Figure 4:
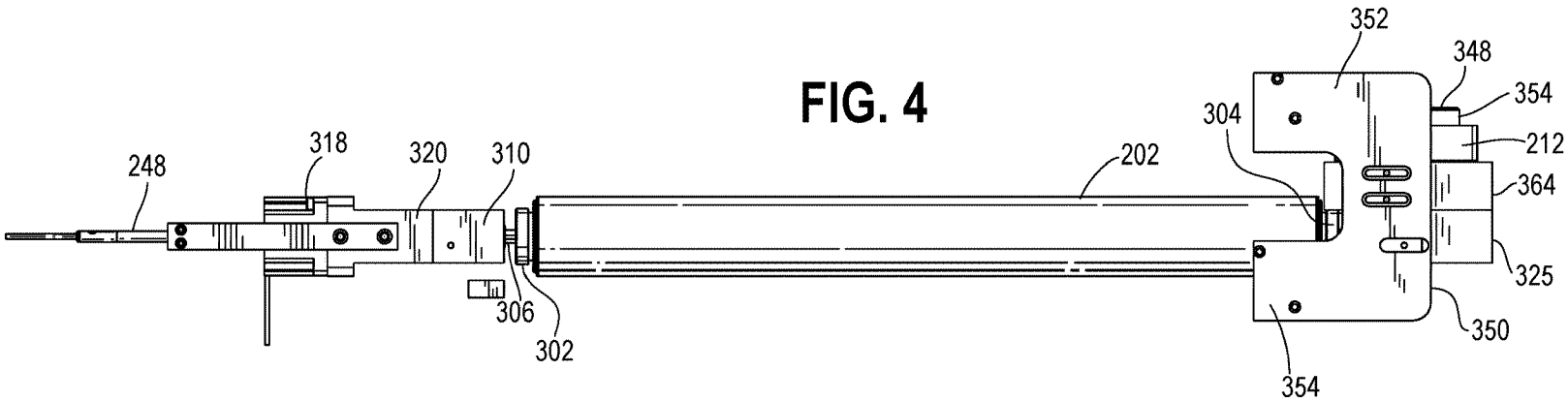
FIGS. 4 and 5 are side elevational and plan views, respectively, of the position control system of FIG. 3.
Figure 5:
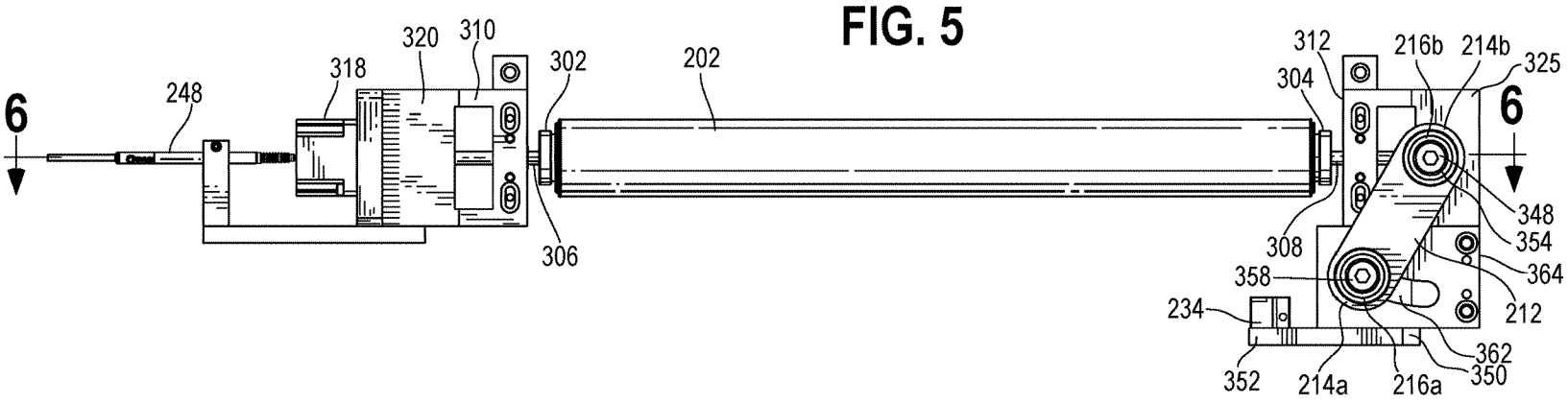

An actuator or motor 230 is also coupled to the roller 202, either directly or via one or more structural elements. In the illustrated exemplary embodiment of FIG. 2, the motor 230 is implemented by a rotary-type actuator and a rotary-to-linear conversion apparatus, although the motor 230 could be of the linear actuator type. In any event, the motor 230 is coupled to and controls the position of the shaft portion 204*a*, and thus the roller 202. If desired, the motor 230 could be coupled to the roller 202 by another element, such as the linkage 212, as seen in FIG. 2A. The motor is operated by a controller 232 that, in the preferred embodiment, is responsive to at least one sensed parameter. In the illustrated embodiment, the controller 232 receives a feedback signal from a position sensor 234 that detects an edge position of the web 118, although a different portion of the web may be sensed or a signal representing a different parameter may be used.

Figure 7:
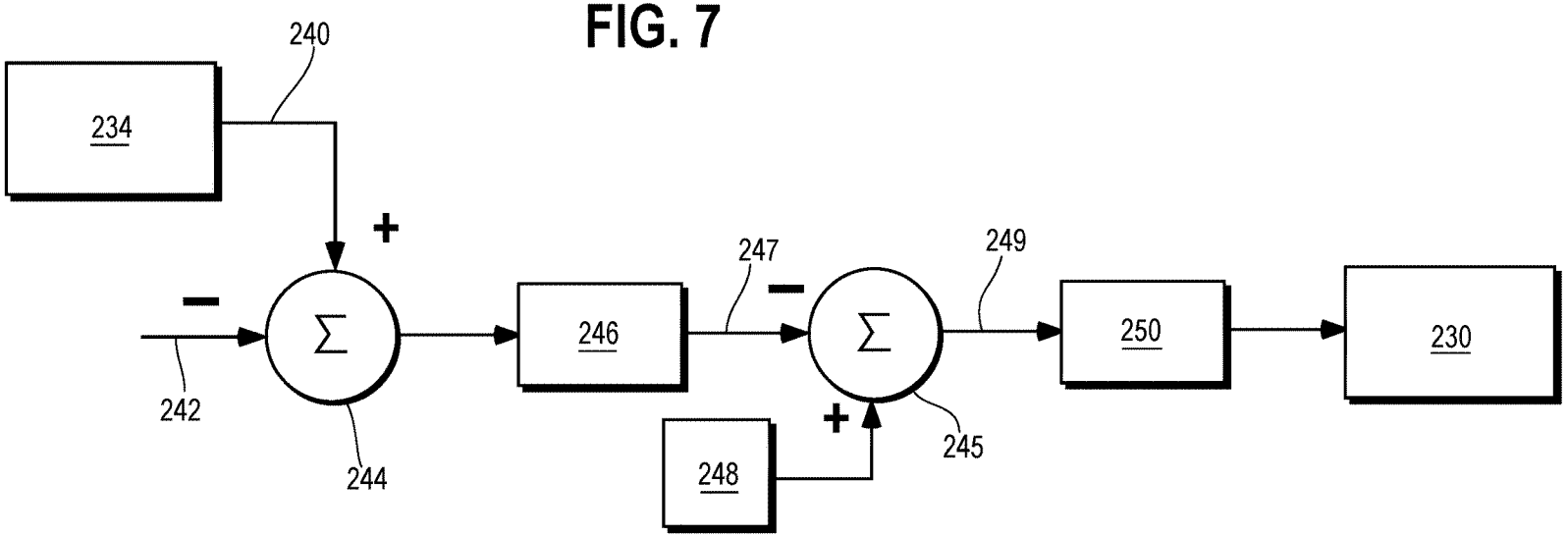
FIG. 7 is a block diagram of an exemplary controller of the control system of FIG. 2.

Referring also to FIG. 7, the controller 232 is responsive to the signal developed by the position sensor 234 on a line 240 as well as a web position target value signal developed on a line 242. The signals on the lines 240 and 242 are subtracted from one another by a first summer 244 to obtain an error signal, which is processed by a proportional-integral-derivative (PID) controller module 246 to develop a signal on a line 247 representing a commanded position for the motor 230. The signal on the line 247 is subtracted from a motor position feedback signal developed by a motor position sensor 248 (FIG. 2) by a second summer 245 to obtain a motor position error signal on a line 249. The signal on the line 249 may be used directly as a control signal to control the motor 230, or the motor position error signal on the line 249 may first be processed by an optional further controller module, such as a PID controller module 250, and the resulting signal may be applied to the motor 230.

It should be noted that the components illustrated in FIG. 7 are exemplary only, and may be replaced by other suitable control components of whatever type, as desired. Thus, for example, the PID controller module 246 and/or 250 may be replaced by a proportional-integral (PI) controller or any other controller module. Also, any or all of the components of FIG. 7 may be implemented by analog or digital components, in which case suitable analog-to-digital and/or digital-to-analog converters may be used. Still further, some or all of the components of FIG. 7 may be implemented by hardware, software, firmware, or a combination thereof. Another method using adaptive control that measures responses and adjusts control parameters is possible. The required amount of tilt motion and y-motion in response to a web position error is determined by a system able to adapt or learn the system response. Such a system utilizes an automated linkage for tilting or automated proportional adjustment.

Referring next to exemplary embodiments of FIGS. 3-6, the roller 202 is journaled on a roller shaft 300 by first and second bearings 302, 304. The roller shaft 300 is, in turn, mounted between two linear bearing rails 306, 308 that extend through and are supported by roll adjuster mounts 310, 312, respectively. A self-aligning linear ball bearing 309 sold by McMaster-Carr Supply Company of Elmhurst, Ill. (part number 6630K12), is disposed inside the roller adjuster mount 310. In the illustrative exemplary embodiment of FIG. 2A, the ball bearing 309 is mounted on the side of roller 202 opposite the linkage 212, but the ball bearing 309 may be disposed on the same side of the linkage 212 through suitable modification. The ball bearing 309 includes a linear bearing and a spherical bushing that allow linear displacement of the bearing rail 306 and further allow a limited degree of tilting of the bearing rail 306 at least along the direction in and out of the page of FIG. 6. One end 314 of the linear bearing rail 306 is contacted by an armature 316 of a motor 318 supported by a motor mount 320. The motor position sensor 248 is mounted to the motor 318 and senses the position of the motor armature 316.

A distal portion 322 of the linear bearing rail 308 is disposed in a spring recess 324 defined by a mounting block 325 and is surrounded by a spring 326 disposed in the recess 324. The spring 326 is disposed between an end wall 328 defining the spring recess 324 and the base wall 329 of this recess in a compressed or uncompressed state. A spring swivel pusher element 330 is clamped around the bearing rail 308 by any suitable means, such as a threaded bolt or other fastener. Adjustment means (not shown) may adjust the height of each side of the roller as required for the particular manufacturing process without restricting tilting movement or movement along the y direction.

The rotary bearing sets 216*a*, 216*b* are identical, and hence, only the bearing set 216*b* will be described in detail. As seen in FIGS. 3, 5, 6, and 6A, the bearing set 216*b* includes two coaxial bearings 332*a*, 332*b* stacked on each other, the first bearing 332*a* having an inner race 333 having a bore 334 therethrough and an outer race 335 surrounding the inner race 333 and radially spaced therefrom, and the second bearing 332*b* having an inner race 336 having a bore 334 therethrough and an outer race 338 surrounding the inner race 336 and radially spaced therefrom. Ball bearings 339 are disposed in the space between the inner races 333, and 336, and the outer races 335, and 338. A bolt, cap screw, or other fastener 348 extends through the bore 334 and is captured in a threaded recess 351 in the spring swivel pusher element 330. The bolt 348 includes an enlarged head 354 that bears against the inner race 333. The outer race is press-fitted or otherwise secured within a bore 356 in the end 214*b* of the linkage 212.

As noted above, the bearing set 216*a* is identical to the bearing set 216*b*. A bolt, cap screw, or other fastener 358 extends through a bore (not shown) in inner races 360, and 361 through an arcuate slot 362 in a sensitivity adjuster plate 364 secured to the mounting block 325. A threaded end 366 of the bolt 358 is threaded in a nut 368 captured within a recess 370 located between the plate 364 and the mounting block 325.

A web edge sensor mount 350 is secured by any suitable means, such as fasteners and/or welds to one or both of the plate 364 and/or the mounting block 325. The web edge position sensor 234 (as shown in the FIGS.) is an IG series sensor sold by Keyence Corporation of America of Itasca, Ill., and is secured to the mount 350 at a location that is suitable for detecting a position of a web passing between legs 352, 354 of the mount 350.

The apparatus illustrated in FIGS. 3-6 is positioned at a selected location along a production line, such as the printing system described above, such that the web 118 or 124 passes between the legs 352, 354 at a desired lateral location before energizing the electrical components of the control system 200. The sensitivity of the control system may be adjusted by loosening the bolt 358 and moving the bolt 358 in the arcuate slot 362, and hence, the end 214*a* of the linkage 212, to a desired position. The bolt 358 is then tightened to maintain the position of the end 214*a* of the linkage 212.

Figure 6:
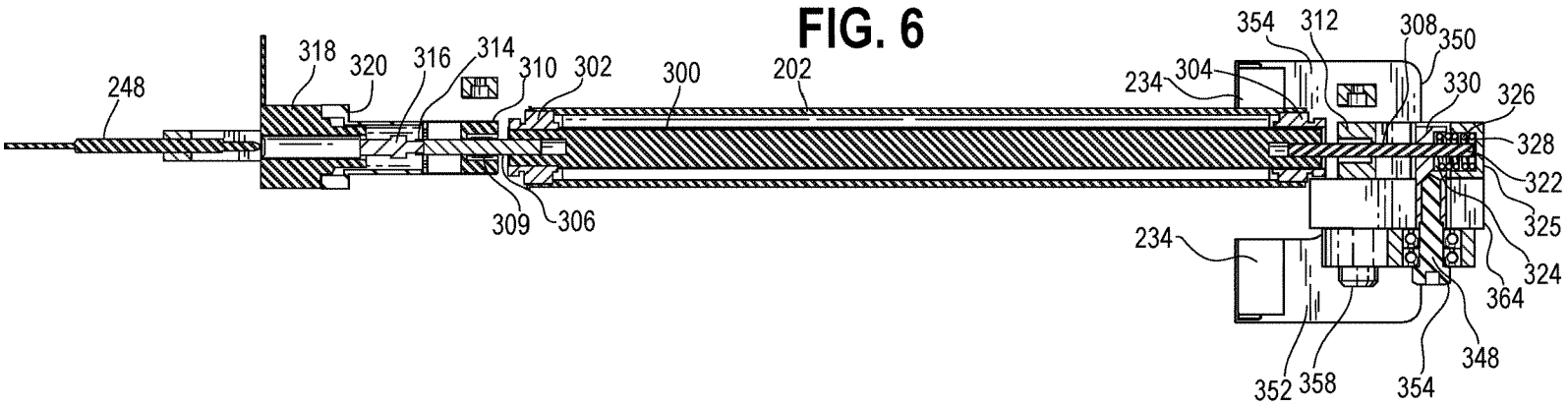
FIG. 6 is a sectional view taken generally along the lines 6-6 of FIG. 5.
Figure 6A:
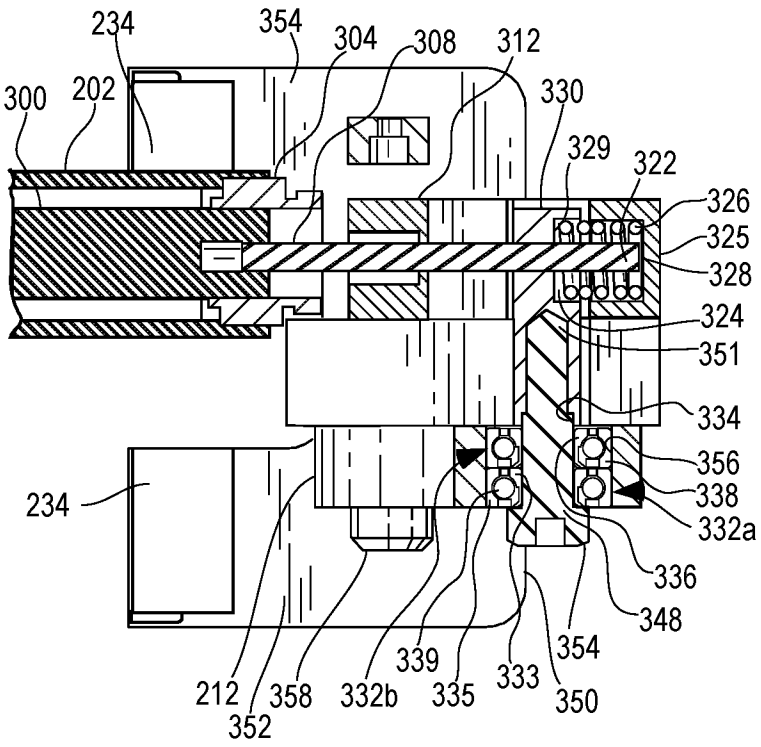
FIG. 6A is a fragmentary, enlarged, sectional view of a portion of the apparatus of FIG. 6.

After energizing and calibrating the control system 200, during production, the control system monitors the lateral web position by sensing the output of the position sensor 234, and if the lateral web position deviates from the target value, the controller 232 operates the motor 318 to move the roller 202 along the y direction. The linkage 212 permits such lateral movement, which movement is facilitated by the fact that the linkage end 214*b*, while being rigidly fixed to the bearing rail 308, is otherwise free to float and moves with the rail 308 with or against the force exerted by the spring 326. During such movement, the fastener 248 and the spring swivel pusher element 330 rotate relative to the end 214*b* of the linkage 212. Also, the end 214*a* of the linkage 212 rotates about the bolt 358, which is fixed in position. This arrangement thus results in concurrent displacement along the y direction and tilting of the roller 202 in and out of the page as seen in FIG. 6. This movement is further facilitated by the bearing 309, which, as previously mentioned, allows lateral displacement and limited tilting of the bearing rail 306, and thus the roller 202. The controller 232 controls the aforementioned concurrent linear and tilting displacement of the rotational axis of the roller 202 via the motor 318 to bring the web edge into alignment with the target value. The resilient loading afforded by the spring 326 results in the ability to control the lateral web position accurately and bidirectionally.

INDUSTRIAL APPLICABILITY

In summary, a position control system is capable of side-to-side linear displacement of a web to rapidly offset position errors along such direction as well as concurrent tilting movement to establish a stable web position at the desired position. The position control system accurately and efficiently corrects for a roll that is offset to one or another side (a static error) or a roll that has lateral runout (uneven edge) and has a compact form factor. An additional benefit of the illustrated exemplary embodiments is the mass of the moving mechanism is lower than most existing solutions, thus allowing for an improved response time to dynamic disturbances in web position without the need for costly actuators and support control systems.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

We claim:

1. A position control system, comprising:

a roller rotatable about a longitudinal axis thereof;

a pivotable member having a first member end rotatable about a first pivot axis and a second member end coupled to the roller wherein the second member end is rotatable about a second pivot axis spaced from the first pivot axis and wherein the first and second pivot axes are movable relative to one another;

a motor adapted to move the roller along the longitudinal axis wherein movement of the roller along the longitudinal axis causes the pivotable member to tilt the roller relative to the longitudinal axis;

a control system responsive to a sensed parameter for controlling the motor; and a first mounting apparatus secured to an end of the roller wherein the first mounting apparatus includes a linear bearing capable of tilting movement, and a second mounting apparatus secured to another end of the roller.

2. The position control system of claim 1, wherein the motor is coupled to the end of the roller.

3. The position control system of claim 1, wherein the motor is coupled to the pivotable member.

4. The position control system of claim 1, wherein the motor and the pivotable member are disposed on a same side of the roller with the first mounting apparatus and wherein the second mounting apparatus includes a linear bearing capable of tilting movement.

5. The position control system of claim 1, wherein the pivotable member is disposed on a side of the roller with the first mounting apparatus and the motor and the second mounting apparatus are disposed on another side of the roller and wherein the second mounting apparatus includes a linear bearing capable of tilting movement.

6. The position control system of claim 1, wherein the motor and the pivotable member are disposed on opposite sides of the roller.

7. The position control system of claim 1, wherein the motor and the pivotable member are disposed on a same side of the roller.

8. The position control system of claim 1, wherein the first pivot axis is fixed and the second pivot axis is movable relative to the first pivot axis.

9. The position control system of claim 1, further including a length of material in contact with the roller wherein the sensed parameter comprises a lateral position of the length of material.

10. The position control system of claim 9, wherein the control system comprises a controller responsive to motor position, actual edge position of the length of material, and a commanded edge position of the length of material.

11. A web position control system for controlling a position of a web to be guided by a roller rotatable about a longitudinal axis thereof, comprising:

a mounting structure that mounts the roller for rotational movement about the longitudinal axis, linear movement parallel to the longitudinal axis, and tilting movement relative to the longitudinal axis;

a pivotable linkage having a first linkage end rotatable about a first pivot axis and a second linkage end coupled to the roller wherein the second linkage end is rotatable about a second pivot axis spaced from the first pivot axis and wherein the first pivot axis is fixed and the second pivot axis is movable relative to the first pivot axis;

a motor adapted to move the roller along the longitudinal axis wherein movement of the roller along the longitudinal axis causes the pivotable member to tilt the roller relative to the longitudinal axis; and a control system including a web position sensor for controlling the motor;

wherein the roller is supported by shaft portions and wherein the mounting structure includes a linear bearing capable of tilting movement supporting one of the shaft portions and the second linkage end is coupled to another of the shaft portions.

12. The web position control system of claim 11, portion wherein the first linkage end is adjustably positionable within an arcuate slot to control sensitivity.

13. The web position control system of claim 12, wherein the control system is responsive to a motor position sensor that senses motor position.

14. A method of controlling lateral position of a web traveling over a roller wherein the roller is mounted for rotation about a longitudinal axis by first and second opposed shaft portions, the method comprising the steps of:

providing a linkage having a first end rotatable about a fixed axis and a second end rotatable about a movable axis spaced from the fixed axis wherein the second end of the linkage is coupled to the roller;

providing a mounting structure that mounts the roller for rotational movement about the longitudinal axis, linear movement parallel to the longitudinal axis, and tilting movement relative to the longitudinal axis and further including the step of providing a linear bearing capable of tilting movement supporting the first shaft portion;

providing a motor coupled to one of the first and second shaft portions and adapted to move the roller along the longitudinal axis wherein movement of the roller along the longitudinal axis causes the linkage to tilt the roller relative to the longitudinal axis;

sensing the lateral position of the web; and controlling the motor in response sensed lateral position of the web in turn to control lateral web position.

15. The method of claim 14, wherein the linkage is coupled to the second shaft portion.

16. The method of claim 14, wherein the step of sensing comprises the step of providing a web edge position sensor and the step of controlling comprises the step of providing a control system responsive to the web edge position sensor and a command signal representing a commanded web edge position.

17. The method of claim 16, wherein the control system is further responsive to a signal representing a position of the motor.

* * * * *